US010265829B2

(12) United States Patent
Tsai et al.

(10) Patent No.: US 10,265,829 B2
(45) Date of Patent: Apr. 23, 2019

(54) CHEMICAL MECHANICAL POLISHING SYSTEM

(71) Applicant: TAIWAN SEMICONDUCTOR MANUFACTURING CO., LTD., Hsinchu (TW)

(72) Inventors: Yu-Yi Tsai, Hsinchu (TW); Wen-Pin Ho, Hsinchu County (TW); Chieh-Han Lee, Taipei (TW); Yu-Hsiang Chao, Taipei (TW)

(73) Assignee: TAIWAN SEMICONDUCTOR MANUFACTURING CO., LTD., Hsinchu (TW)

( * ) Notice: Subject to any disclaimer, the term of this patent is extended or adjusted under 35 U.S.C. 154(b) by 101 days.

(21) Appl. No.: 14/928,975

(22) Filed: Oct. 30, 2015

(65) Prior Publication Data

US 2017/0120414 A1 May 4, 2017

(51) Int. Cl.

| | |
|---|---|
| ***B24B 37/20*** | (2012.01) |
| ***B24B 37/32*** | (2012.01) |
| ***B24B 53/02*** | (2012.01) |
| ***B24B 53/12*** | (2006.01) |

(52) U.S. Cl.

CPC ..... *B24B 37/20* (2013.01); *B24B 37/32* (2013.01); *B24B 53/02* (2013.01); *B24B 53/12* (2013.01)

(58) Field of Classification Search

CPC ..... B24B 49/18; B24B 53/017; B24B 53/02; B24B 53/12; B24B 37/32; B24B 37/04; B24B 37/05

See application file for complete search history.

(56) References Cited

U.S. PATENT DOCUMENTS

| | | | | |
|---|---|---|---|---|
| 5,842,912 | A * | 12/1998 | Holzapfel | B24B 53/12 125/3 |
| 5,857,899 | A * | 1/1999 | Volodarsky | B24B 37/04 451/398 |
| 6,004,193 | A * | 12/1999 | Nagahara | B24B 53/017 451/285 |
| 6,019,670 | A * | 2/2000 | Cheng | B24B 37/32 451/286 |
| 6,077,155 | A * | 6/2000 | Hayakawa | B24B 37/30 451/288 |
| 6,139,428 | A * | 10/2000 | Drill | B24B 53/12 451/286 |
| 6,371,838 | B1 * | 4/2002 | Holzapfel | B24B 53/017 125/3 |
| 6,398,906 | B1 * | 6/2002 | Kobayashi | B24B 41/061 156/345.12 |
| 6,565,705 | B2 * | 5/2003 | Hung | B24B 37/32 156/345.12 |

(Continued)

*Primary Examiner* — Timothy V Eley
(74) *Attorney, Agent, or Firm* — Maschoff Brennan

(57) ABSTRACT

A chemical mechanical polishing system includes a platen, a slurry introduction device and at least one polishing head. The platen is configured to allow a polishing pad to be disposed thereon. The slurry introduction device is configured to supply slurry onto the polishing pad. The polishing head includes a main body and at least one grinding piece. The main body has an accommodation space for accommodating a wafer. The grinding piece is disposed on the main body. The grinding piece has a grinding surface configured to grind against the polishing pad.

20 Claims, 5 Drawing Sheets

(56) References Cited

U.S. PATENT DOCUMENTS

| | | | | |
|---|---|---|---|---|
| 6,699,107 | B2 * | 3/2004 | Stoeckgen | B24B 37/32 451/289 |
| 6,730,191 | B2 * | 5/2004 | Chang | B24B 53/017 156/345.12 |
| RE39,195 | E * | 7/2006 | Doan | B24D 7/18 451/287 |
| 7,740,521 | B2 * | 6/2010 | Hashimoto | B24B 37/30 451/289 |
| 9,604,340 | B2 * | 3/2017 | Lin | B24B 37/32 |
| 2017/0157742 | A1 * | 6/2017 | Lin | B24B 53/017 |

* cited by examiner

CHEMICAL MECHANICAL POLISHING SYSTEM

BACKGROUND

The present disclosure generally relates to chemical mechanical polishing systems.

Chemical mechanical polishing is a process in which an abrasive slurry and a polishing pad work simultaneously together in both the chemical and mechanical approaches to flatten a wafer. During the process, the wafer is compressed towards the polishing pad and both the wafer and the polishing pad are rotated. Thus, the wafer is rubbed against the polishing pad. Together with the chemical action of the slurry, this can remove material and tend to even out any irregular topography, making the wafer flat for planar.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
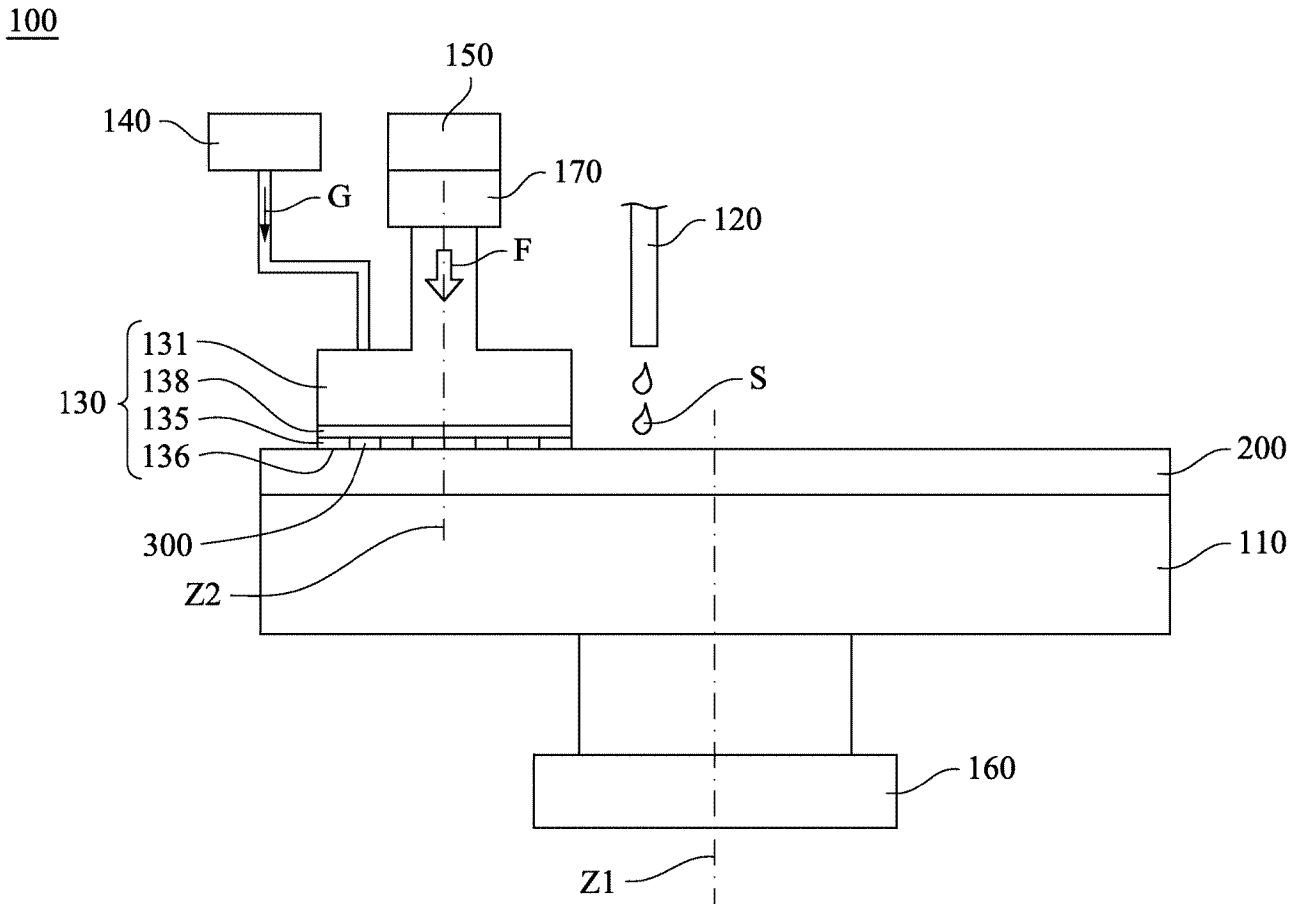
FIG. 1 is a schematic view of a chemical mechanical polishing system in accordance with some embodiments of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", or "includes" and/or "including" or "has" and/or "having" when used in this specification, specify the presence of stated features, regions, integers, operations, operations, elements, and/or components, but do not preclude the presence or addition of one or more other features, regions, integers, operations, operations, elements, components, and/or groups thereof.

Furthermore, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Figure 2:
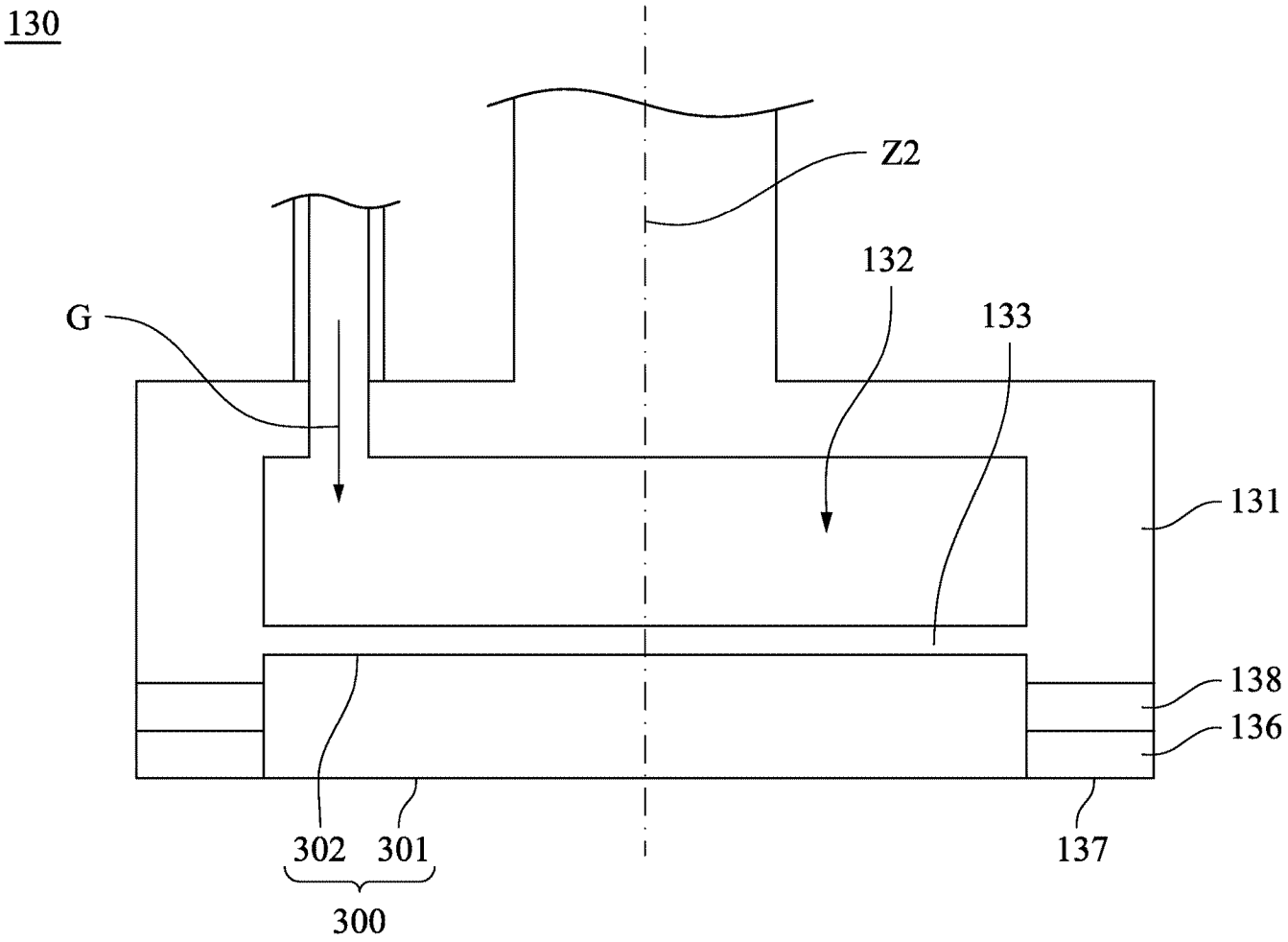
FIG. 2 is a partially sectional view of the polishing head of FIG. 1.

Reference is made to FIGS. 1 and 2. FIG. 1 is a schematic view of a chemical mechanical polishing system 100 in accordance with some embodiments of the present disclosure. FIG. 2 is a partially sectional view of the polishing head 130 of FIG. 1. As shown in FIGS. 1 and 2, the chemical mechanical polishing system 100 includes a platen 110, a slurry introduction device 120 and at least one polishing head 130. The platen 110 is configured to allow a polishing pad 200 to be disposed thereon. The slurry introduction device 120 is configured to supply slurry S onto the polishing pad 200. The polishing head 130 includes a main body 131 and at least one grinding piece 135. The main body 131 has an accommodation space A for accommodating a wafer 300. The first surface 301 of the wafer 300 faces to the polishing pad 200. The grinding piece 135 is disposed on the main body 131. The grinding piece 135 has a grinding surface 136 configured to grind against the polishing pad 200.

In some embodiments, as shown in FIG. 1, the chemical mechanical polishing system 100 further includes a compressing device 150. The compressing device 150 is configured for applying a downward force F to press the polishing head 130 towards the polishing pad 200 such that the grinding surface 136 of the grinding piece 135 contacts with the polishing pad 200. In other words, the grinding surface 136 of the grinding piece 135 contacts with the polishing pad 200 under the action of the downward force F.

In addition, as shown in FIG. 1, the chemical mechanical polishing system 100 further includes a first rotating device 160. The first rotating device 160 is configured for rotating the platen 110 about a first axis Z1.

On the other hand, as shown in FIG. 1, the chemical mechanical polishing system 100 further includes a second rotating device 170. The second rotating device 170 is configured for rotating the polishing head 130 about a second axis Z2, in which the second axis Z2 and the first axis Z1 are substantially parallel with each other. Furthermore, the first rotating device 160 and the second rotating device 170 can be operated independently. This means, during the operation of the chemical mechanical polishing system 100, the rotation of the platen 110 about the first axis Z1 and the rotation of the polishing head 130 about the second axis Z2 can be operated independently. In other words, during the operation of the chemical mechanical polishing system 100, the rotation of the polishing pad 200 about the first axis Z1 and the rotation of the wafer 300 about the second axis Z2 can be operated independently.

To be more specific, as shown in FIG. 2, the main body 131 of the polishing head 130 includes a chamber 132 and a membrane 133. In some embodiments, the chamber 132 is fluidly connected to a gas source 140. The membrane 133 seals the chamber 132. The membrane 133 is configured to abut against a second surface 302 of the substrate 300, in which the second surface 302 is opposite to the first surface 301 of the wafer 300. In other words, the wafer 300 is communicated with the chamber 132 through the membrane 133.

As mentioned above, the chamber 132 of the polishing head 130 is fluidly connected to the gas source 140. During the operation of the chemical mechanical polishing system 100, when the polishing of the wafer 300 is carried out, the gas source 140 supplies a gas G to the chamber 132 of the polishing head 130 such that the wafer 300 communicated with the chamber 132 through the membrane 133 is pressed against the polishing pad 200. In other words, the force that the wafer 300 is pressed against the polishing pad 200 is related to the pressure developed in the chamber 132 of the polishing head 130 by the gas G supplied from the gas source 140.

In practical applications, during the operation of the chemical mechanical polishing system 100, the slurry S is supplied on the polishing pad 200 from the slurry introduction device 120. In order to increase the efficiency of the chemical mechanical polishing system 100, the slurry S is typically an abrasive and corrosive chemical solution. As mentioned above, the first rotating device 160 is configured for rotating the platen 110 about the first axis Z1. In this way, the polishing pad 200 is also rotated by the first rotating device 160 since the polishing pad 200 is disposed on the platen 110. The region of the polishing pad 200 on which the slurry S is supplied will be rotated to a location where the platen head 130, or the wafer 300, is facing. When the platen head 130 is pressed towards the polishing pad 200 under the action of the downward force F and the wafer 300 is pressed against the polishing pad 200 under the pressure developed in the chamber 132 by the gas G, such that the wafer 300 contacts with the polishing pad 200, the slurry S will be compressed between the wafer 300 and the polishing pad 200. Afterwards, a chemical reaction between the wafer 300 and the slurry S occurs. Together with the relative motions between the wafer 300 and the polishing pad 200 in a mechanical way, any irregular topography of the wafer 300 is then evened out.

To be more specific, during the operation of the chemical mechanical polishing system 100, the compressing device 150 is operated to apply the downward force F to press the polishing head 130 towards the polishing pad 200 and the gas source 140 is operated to supply the gas G to the chamber 132 of the polishing head 130. In this way, the wafer 300 accommodated in the main body 131 of the polishing head 130 contacts with the polishing pad 200 under the pressure developed in the chamber 132 by the gas G supplied from the gas source 140. Moreover, as mentioned above, the first rotating device 160 is configured for rotating the platen 110 about the first axis Z1. In other words, the polishing pad 200 can be rotated about the first axis Z1. On the other hand, the second rotating device 170 is configured for rotating the polishing head 130 about the second axis Z2, in which the second axis Z2 and the first axis Z1 are substantially parallel with each other. In other words, the wafer 300 can be rotated about the second axis Z2. In this way, when the wafer 300 contacts with the polishing pad 200 under the pressure developed in the chamber 132 by the gas G supplied from the gas source 140, at least one of the rotation of the polishing pad 200 about the first axis Z1 and the rotation of the wafer 300 about the second axis Z2 will cause the wafer 300 and the polishing pad 200 to rub against each other. In some embodiments, in the same period of time, the polishing pad 200 is rotated about the first axis Z1 while the wafer 300 is rotated about the second axis Z2. As a result, the protruding materials on the wafer 300 are removed mechanically and any irregular topography of the wafer 300 can then be evened out. Together with the chemical effect of the slurry S against the wafer 300 as mentioned above, the wafer 300 can be polished to be flat or planar during the operation of the chemical mechanical polishing system 100.

As shown in FIGS. 1-2, as mentioned above, the polishing head 130 includes at least one grinding piece 135 disposed on the main body 131 and the grinding piece 135 has the grinding surface 136, in which the grinding surface 136 is configured to grind against the polishing pad 200. When the wafer 300 contacts with the polishing pad 200 under the pressure developed in the chamber 132 by the gas G supplied from the gas source 140, and at least one of the polishing pad 200 is rotated about the first axis Z1 and the wafer 300 is rotated about the second axis Z2, apart from the rubbing of the wafer 300 and the polishing pad 200 against each other, the grinding surface 136 of the grinding piece 135 also grinds against the polishing pad 200 under the action of the downward force F. In this way, any debris formed from the removal of the protruding materials from the wafer 300 and accumulated on the polishing pad 200 will be removed and cleared by the grinding surface 136 of the grinding piece 135 during the polishing of the wafer 300. As a result, the efficiency of the chemical mechanical polishing system 100 is increased. Furthermore, the polishing pad 200 is continually refurbished by the grinding piece 135 of the polishing head 130 during the operation of the chemical mechanical polishing system 100. In this way, during the operation of the chemical mechanical polishing system 100, the flatness and the thickness uniformity of the wafer 300 can be correspondingly improved. In other words, the quality of the polishing of the wafer 300 by both the chemical and mechanical approaches is improved.

In addition, since the rotation of the polishing head 130 about the axis Z2 to make the wafer 300 to rub against the polishing pad 200 and to make the grinding piece 135 to grind against the polishing pad 200 can be carried out by the single first rotating device 160 at the same time, the overall structure of the chemical mechanical polishing system 100 is made simple. Correspondingly, this means that the manufacturing cost of the chemical mechanical polishing system 100 can be decreased.

In practical applications, in order to achieve the grinding effect of the grinding piece 135 of the polishing head 130 against the polishing pad 200, the grinding surface 136 of the grinding piece 135 is harder than the polishing pad 200. In this way, the grinding piece 135 will not be worn by the polishing pad 200 during the grinding of the polishing pad 200 by the grinding piece 135. Instead, any debris formed from the removal of the protruding materials from the wafer 300 and accumulated on the polishing pad 200 can be removed and cleared by the grinding surface 136 of the grinding piece 135 in an effective manner.

Furthermore, in order to increase the grinding effect of the grinding piece 135 of the polishing head 130 against the polishing pad 200, the grinding piece 135 of the polishing head 130 includes a plurality of grinding particles 137 (not shown in FIGS. 1-2) disposed on the grinding surface 136. The grinding particles 137 are configured to grind against the polishing pad 200. In order to increase the grinding effect of the grinding piece 135 of the polishing head 130 against the polishing pad 200, the grinding particles 137 are made of a material harder than the polishing pad 200. In some embodiments, the grinding particles 137 are made of diamond.

In other words, the grinding particles 137 made of diamond are disposed on the grinding surface 136 of the grinding piece 135. With the grinding particles 137 made of diamond, the grinding efficiency of the grinding piece 135 against the polishing pad 200 is correspondingly increased. It is noted that the material of diamond as cited here are only illustrative and does not intend to limit the claimed scope. A person having ordinary skill in the art of the present disclosure may flexibly choose the material of the grinding particles 137 to be disposed on the grinding surface 136 depending on actual situations.

Structurally speaking, the polishing head 130 further includes a retainer ring 138. The retainer ring 138 is configured to retain the wafer 300 in the accommodation space A. As shown in FIGS. 1-2, the retainer ring 138 is disposed between the main body 131 and the grinding piece 135 of the polishing head 130. In other words, the grinding particles 137 are disposed on a surface of the retainer ring 138 facing away from the main body 131. Moreover, the retainer ring 138 has an inner diameter larger than the wafer 300, such that the wafer 300 is located in an inner space of the retainer ring 138. Generally speaking, the retainer ring 138 is made of a plastic material.

Figure 3:
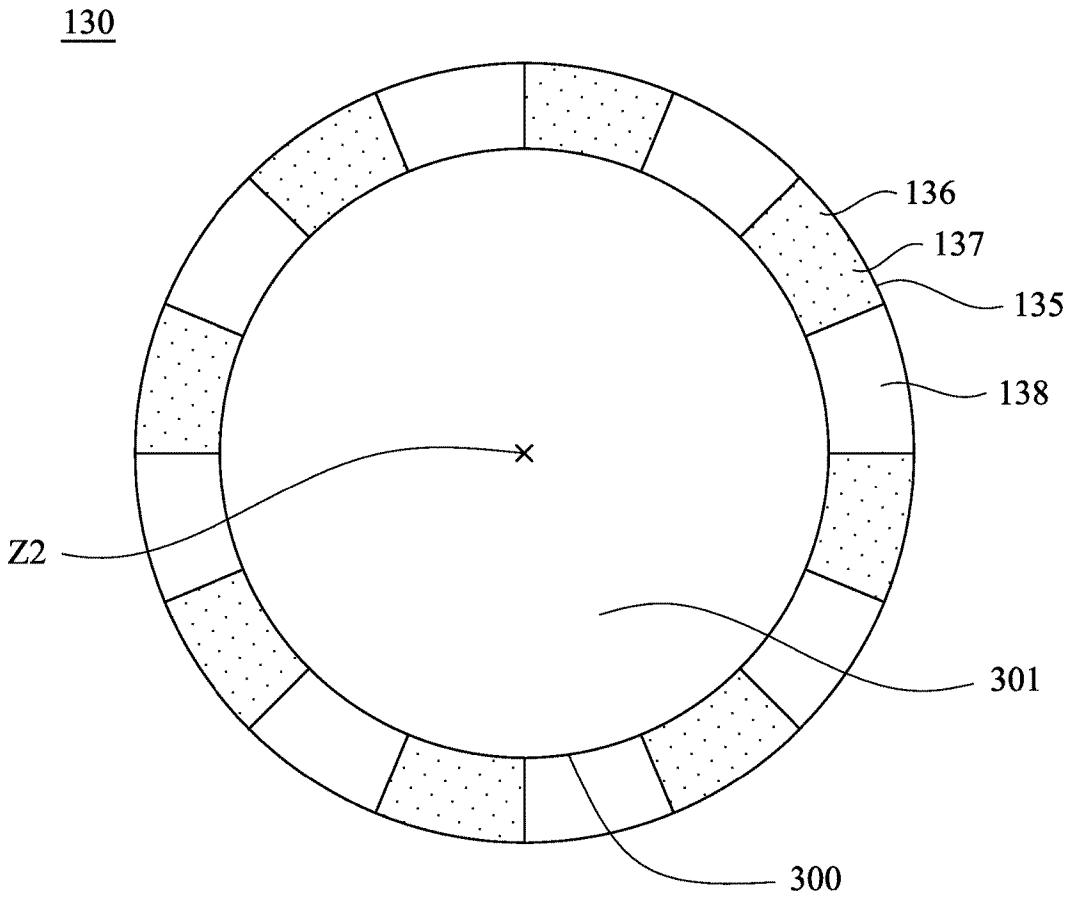
FIG. 3 is a bottom view of the polishing head of FIG. 1.

Reference is made to FIG. 3. FIG. 3 is a bottom view of the polishing head 130 of FIG. 1. In some embodiments, the quantity of the grinding piece 135 is plural. As shown in FIG. 3, a plurality of the grinding pieces 135 is evenly disposed on the main body 131 of the polishing head 130 such that the accommodation space A and thus the first surface 301 of the wafer 300 is surrounded by the grinding pieces 135. In other words, the grinding particles 137 are separated into a plurality of groups, and the accommodation space A and thus the first surface 301 of the wafer 300 is surrounded by the groups of the grinding particles 137. This means, the grinding particles 137 are grouped around the accommodation space A. In this way, the center of mass of the grinding pieces 135 will coincide with the second axis Z2. In other words, the balance of the grinding pieces 135 is geometrically achieved. As a result, during the rotation of the polishing head 130 about the second axis Z2 by the second rotating device 170, the stability of the polishing head 130 is maintained.

Figure 4:
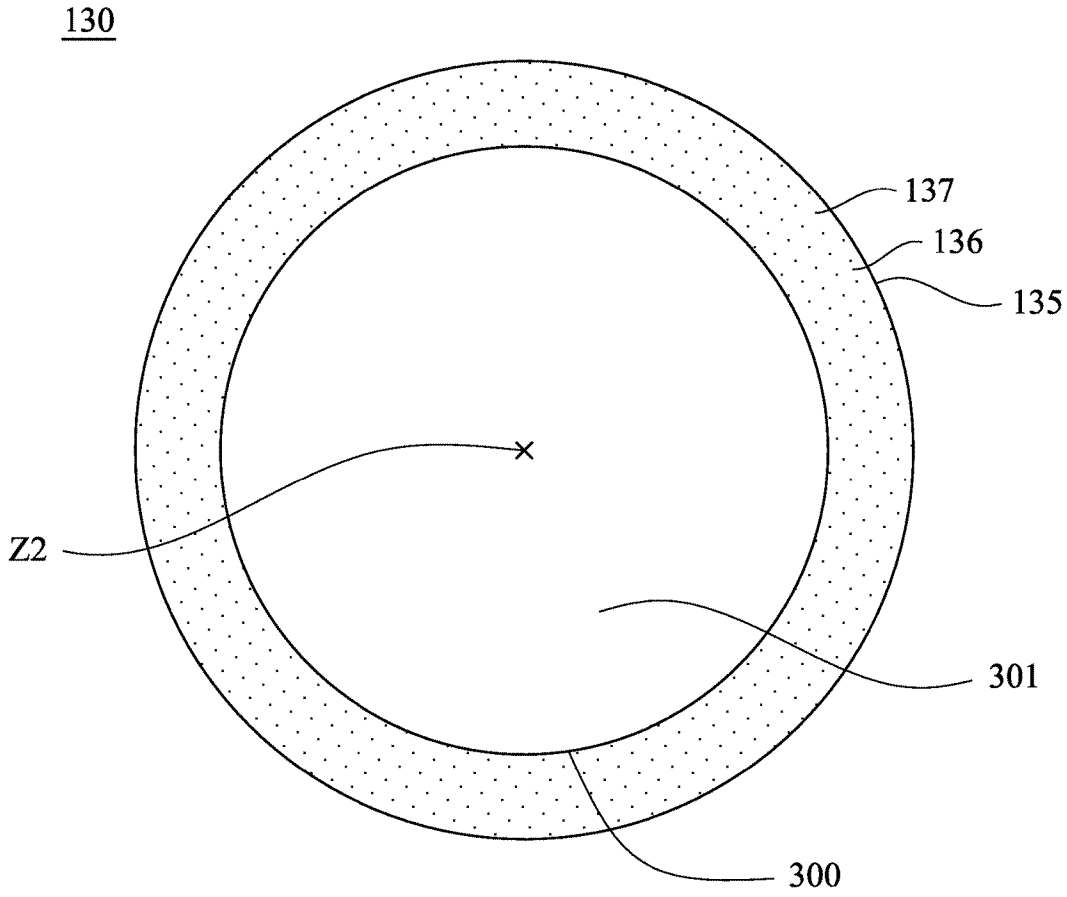
FIG. 4 is a bottom view of a polishing head in accordance with some other embodiments of the present disclosure.

Reference is made to FIG. 4. FIG. 4 is a bottom view of the polishing head 130 in accordance with some other embodiments of the present disclosure. As shown in FIG. 4, the grinding piece 135 has a ring shape, and the accommodation space A and thus the first surface 301 of the wafer 300 is surrounded by the grinding piece 135. Same as above, the center of mass of the grinding piece 135 of the ring shape coincides with the second axis Z2. Similarly, the balance of the grinding piece 135 of the ring shape is geometrically achieved. As a result, during the rotation of the polishing head 130 about the second axis Z2 by the second rotating device 170, the stability of the polishing head 130 is maintained.

Figure 5:
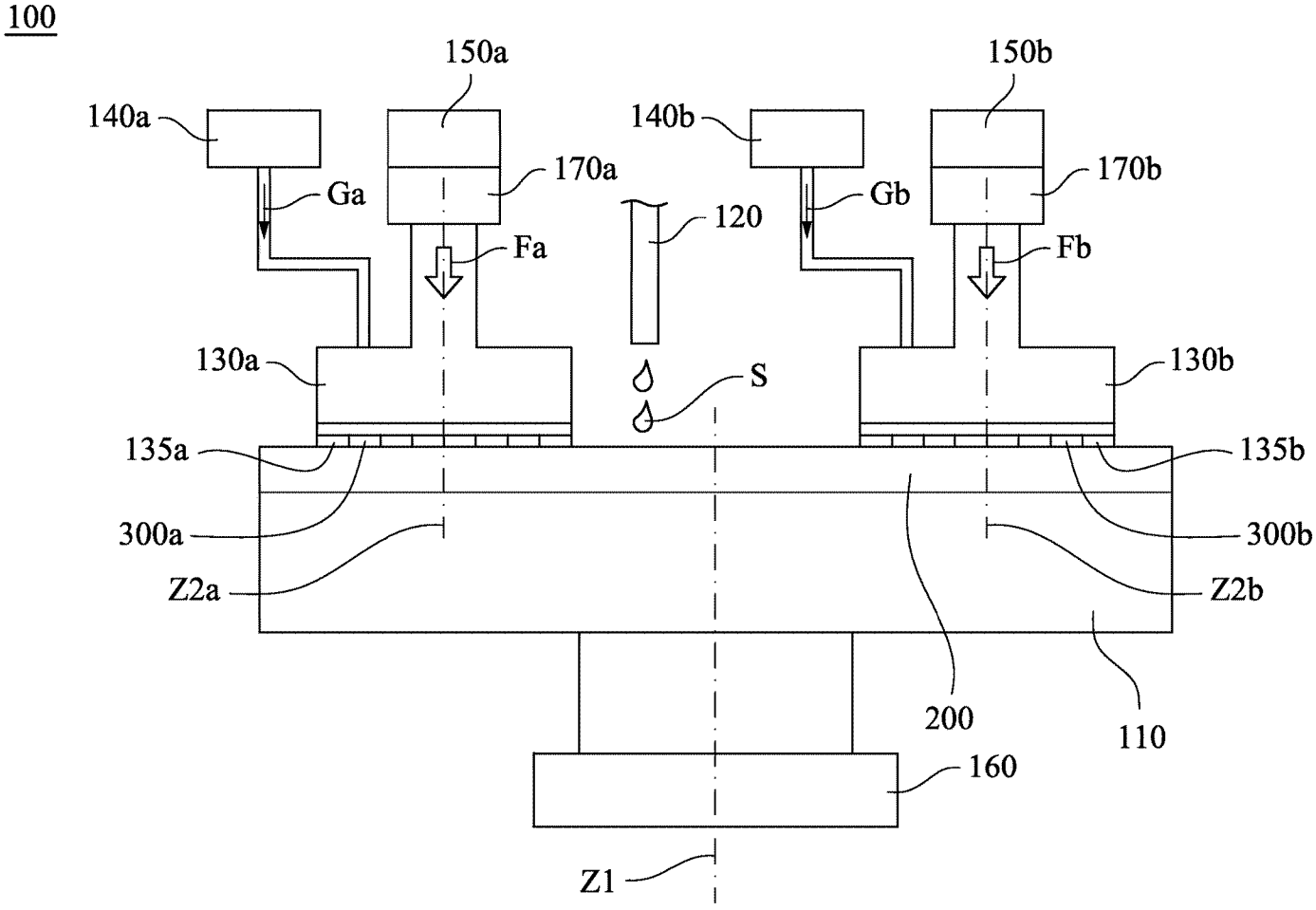
FIG. 5 is a schematic view of a chemical mechanical polishing system in accordance with some other embodiments of the present disclosure.

Reference is made to FIG. 5. FIG. 5 is a schematic view of the chemical mechanical polishing system 100 in accordance with some other embodiments of the present disclosure. In some embodiments, the quantity of the polishing head 130 is plural. As mentioned above, since the rotation of the polishing head 130 about the axis Z2 to make the wafer 300 to rub against the polishing pad 200 and to make the grinding piece 135 to grind against the polishing pad 200 can be carried out by the single first rotating device 160 at the same period of time, the overall structure of the chemical mechanical polishing system 100 is made simple. In this way, more room is available and the chemical mechanical polishing system 100 can include more than one polishing head 130, and thus more than one wafer 300 can be polished chemically and mechanically by the single chemical mechanical polishing system 100 at the same period of time.

To be more specific, as shown in FIG. 5, the quantity of the polishing heads 130 is two, namely the polishing head 130*a* and the polishing head 130*b*. For instance, taking the polishing head 130*a* as an example, in some embodiments, the compressing device 150*a* is configured for applying a downward force Fa to press the polishing head 130*a* towards the polishing pad 200 such that the grinding piece 135*a* contacts with the polishing pad 200. Meanwhile, the second rotating device 170*a* is configured for rotating the polishing head 130*a* about the second axis Z2*a*, in which the second axis Z2*a* and the first axis Z1 are substantially parallel with each other. Furthermore, the gas source 140*a* is fluidly connected to the chamber (not shown) of the polishing head 130*a*.

During the operation of the chemical mechanical polishing system 100, the slurry S is supplied on the polishing pad 200 from the slurry introduction device 120. The compressing device 150*a* is operated to apply the downward force Fa to press the polishing head 130*a* towards the polishing pad 200 and the gas source 140*a* is operated to supply the gas Ga to the chamber (not shown) of the polishing head 130*a*. In this way, the wafer 300*a* accommodated in the polishing head 130*a* contacts with the polishing pad 200 under the pressure developed in the chamber by the gas Ga supplied from the gas source 140*a*, while the grinding piece 135*a* is pressed against the polishing pad 200. Moreover, the polishing pad 200 is rotated by the first rotating device 160 about the first axis Z1. On the other hand, the wafer 300 is rotated by the second rotating device 170*a* about the second axis Z2*a*. In this way, during the rotation of the polishing pad 200 about the first axis Z1 and the rotation of the wafer 300*a* about the second axis Z2*a*, apart from the rubbing of the wafer 300*a* and the polishing pad 200 against each other, the grinding piece 135*a* also grinds against the polishing pad 200 under the action of the downward force Fa. In this way, any debris formed from the removal of the protruding materials from the wafer 300*a* and accumulated on the polishing pad 200 will be removed and cleared by the grinding piece 135*a* during the polishing of the wafer 300*a*. Furthermore, the polishing pad 200 is continually refurbished by the grinding piece 135*a* of the polishing head 130*a* during the operation of the chemical mechanical polishing system 100. In this way, during the operation of the chemical mechanical polishing system 100, the flatness and the thickness uniformity of the wafer 300*a* can be correspondingly improved. In other words, the quality of the polishing of the wafer 300*a* by the both the chemical and mechanical approaches is improved.

In the same period of time or in a different period of time, during the operation of the chemical mechanical polishing system 100, similarly, the compressing device 150*b* is operated to apply the compression force Fb to press the polishing head 130*b* towards the polishing pad 200 and the gas source 140*b* is operated to supply the gas Gb to the chamber (not shown) of the polishing head 130*b*. In this way, the wafer 300*b* accommodated in the polishing head 130*b* contacts with the polishing pad 200 under the pressure developed in the chamber by the gas Gb supplied from the gas source 140*b*, while the grinding piece 135*b* is pressed against the polishing pad 200. Moreover, the polishing pad 200 is rotated by the first rotating device 160 about the first axis Z1. On the other hand, the wafer 300*b* is rotated by the second rotating device 170*b* about the second axis Z2*b*. In this way, during the rotation of the polishing pad 200 about the first axis Z1 and the rotation of the wafer 300*b* about the second axis Z2*b*, apart from the rubbing of the wafer 300*b* and the polishing pad 200 against each other, the grinding piece 135*b* also grinds against the polishing pad 200 under the action of the downward force Fb. In this way, any debris formed from the removal of the protruding materials from the wafer 300*b* and accumulated on the polishing pad 200 will be removed and cleared by the grinding piece 135*b* during the polishing of the wafer 300*a*. Furthermore, the polishing pad 200 is continually refurbished by the grinding piece 135*b* of the polishing head 130*b* during the operation of the chemical mechanical polishing system 100. In this way, during the operation of the chemical mechanical polishing system 100, the flatness and the thickness uniformity of the wafer 300*b* can be correspondingly improved. In other words, the quality of the polishing of the wafer 300*b* by the both the chemical and mechanical approaches is improved.

Since the wafer 300*a* and the wafer 300*b* can be polished to be flat or planar by the operation of the chemical mechanical polishing system 100 in the same period of time, the efficiency of the chemical mechanical polishing system 100 is increased. Consequently, the cost of operation of the chemical mechanical polishing system 100 is correspondingly decreased.

For the sake of simplicity, in some embodiments, the gas source 140*a* and the gas source 140*b* can be of the single gas source. Similarly, the compressing device 150*a* and the compressing device 150*b* can be of the single compressing device. Moreover, the second rotating device 170*a* and the second rotating device 170*b* can be of the single second rotating device.

Furthermore, it is noted that the number of the polishing heads 130 as cited here is only illustrative and does not intend to limit the claimed scope. A person having ordinary skill in the art of the present invention may flexibly choose the number of the polishing heads 130 of the chemical mechanical polishing system 100 depending on actual situations.

With reference to the chemical mechanical polishing system 100 as mentioned above, the embodiments of the present disclosure further provide a method for polishing the wafer 300. The method includes the following steps (it is appreciated that the sequence of the steps and the sub-steps as mentioned below, unless otherwise specified, all can be adjusted according to the actual needs, or even executed at the same time or partially at the same time):

(1) supplying the slurry S onto the polishing pad 120.

(2) holding the wafer 300 against the polishing pad 200 by the polishing head 130, in which the polishing head 130 has a grinding surface 136 against the polishing pad 200 when the wafer 300 is held against the polishing pad 200.

(3) rotating at least one of the polishing pad 200 and the polishing head 130, such that the wafer 300 and the polishing pad 200 rub against each other, and the grinding surface 136 grinds against the polishing pad 200.

To be more specific, during the operation of the chemical mechanical polishing system 100, the slurry S is supplied on the polishing pad 200 from the slurry introduction device 120. The wafer 300 is held against the polishing pad 200 by the polishing head 130. The polishing head 130 has a grinding surface 136 facing against the polishing pad 200 when the wafer 300 is held against the polishing pad 200. Afterwards, at least one of the polishing pad 200 and the polishing head 130 is rotated, such that the wafer 300 and the polishing pad 200 rub against each other, and the grinding surface 136 grinds against the polishing pad 200. In this way, at least a part of the polishing pad 200 is removed by the grinding surface 136, and any debris formed from the removal of the protruding materials from the wafer 300 and accumulated on the polishing pad 200 will be removed and cleared by the grinding surface 136 during the rotation of either or both of the platen 110 about the axis Z1 and the rotation of the polishing head 130 about the axis Z2. As a result, the polishing pad 200 is continually refurbished by the grinding piece 135 of the polishing head 130 during the operation of the chemical mechanical polishing system 100. In this way, during the operation of the chemical mechanical polishing system 100, the flatness and the thickness uniformity of the wafer 300 can be improved. In other words, the quality of the polishing of the wafer 300 by the both the chemical and mechanical approaches is improved.

Moreover, in order to press the wafer 300 against the polishing pad 200 so as to increase the grinding efficiency of the grinding surface 136 against the polishing pad 200, the method for polishing the wafer 300 further includes:

(4) applying the downward force F to the polishing head 130 that urges the grinding surface 136 against the polishing pad 200 during the rotating.

In this way, during the operation of the chemical mechanical polishing system 100, the polishing head 130 is pressed by the downward force F, and the grinding surface 136 grinds against the polishing pad 200 under the action of the downward force F.

According to various embodiments of the present disclosure, since the polishing head 130 includes at least one grinding piece 135 disposed on the main body 131 and the grinding piece 135 has the grinding surface 136, in which the grinding surface 136 is configured to grind against the polishing pad 200. When the wafer 300 contacts with the polishing pad 200 under the pressure developed in the chamber 132 by the gas G supplied from the gas source 140, and at least one of the polishing pad 200 is rotated about the first axis Z1 and the wafer 300 is rotated about the second axis Z2, apart from the rubbing of the wafer 300 and the polishing pad 200 against each other, the grinding surface 136 of the grinding piece 135 also grinds against the polishing pad 200 under the action of the downward force F. In this way, any debris formed from the removal of the protruding materials from the wafer 300 and accumulated on the polishing pad 200 will be removed and cleared by the grinding surface 136 of the grinding piece 135 during the polishing of the wafer 300. As a result, the efficiency of the chemical mechanical polishing system 100 is increased. Furthermore, the polishing pad 200 is continually refurbished by the grinding piece 135 of the polishing head 130 during the operation of the chemical mechanical polishing system 100. In this way, during the operation of the chemical mechanical polishing system 100, the flatness and the thickness uniformity of the wafer 300 can be correspondingly improved. In other words, the quality of the polishing of the wafer 300 by the both the chemical and mechanical approaches is improved.

According to various embodiments of the present disclosure, the chemical mechanical polishing system includes the platen, the slurry introduction device and at least one polishing head. The platen is configured to allow the polishing pad to be disposed thereon. The slurry introduction device is configured to supply the slurry onto the polishing pad. The polishing head includes the main body and at least one grinding piece. The main body has the accommodation space for accommodating the wafer. The grinding piece is disposed on the main body. The grinding piece has the grinding surface configured to grind against the polishing pad.

According to various embodiments of the present disclosure, the chemical mechanical polishing system includes the platen, the slurry introduction device and at least one polishing head. The platen is configured to allow the polishing pad to be disposed thereon. The slurry introduction device is configured to supply the slurry onto the polishing pad. The polishing head includes the main body and the grinding particles. The main body has the accommodation space for accommodating the wafer. The grinding particles are disposed on the main body and are configured to grind against the polishing pad.

According to various embodiments of the present disclosure, the method for polishing the wafer is provided. The method includes supplying the slurry onto the polishing pad, holding the wafer against the polishing pad by the polishing head, in which the polishing head has the grinding surface against the polishing pad when the wafer is held against the polishing pad, and rotating at least one of the polishing pad and the polishing head, such that the wafer and the polishing pad rub against each other, and the grinding surface grinds against the polishing pad.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A chemical mechanical polishing system comprising:
a platen;
a polishing pad disposed on the platen;
a slurry introducing device configured to supply slurry onto the polishing pad; and
a polishing head comprising:
a main body having an accommodation space for accommodating a wafer;
a retainer ring configured to retain the wafer; and
at least one grinding piece disposed on the retainer ring, the at least one grinding piece having at least a pair of grinding surfaces configured to grind against the polishing pad and separated by a portion of the retainer ring that is void of a grinding surface, wherein the portion of the retainer ring that is void of the grinding surface abuts at least one of the grinding surfaces and has a side and the side substantially follows a line that passes through a center point of the retainer ring.

2. The chemical mechanical polishing system of claim 1, wherein the grinding surfaces are harder than the polishing pad.

3. The chemical mechanical polishing system of claim 1, wherein the grinding piece comprises a plurality of grinding particles disposed on the grinding surfaces.

4. The chemical mechanical polishing system of claim 3, wherein the grinding particles are made of diamond.

5. The chemical mechanical polishing system of claim 1, wherein the main body comprises:
a chamber fluidly connected to a gas source; and
a membrane sealing the chamber, the membrane being configured to abut against the wafer.

6. The chemical mechanical polishing system of claim 1, wherein the retainer ring is disposed between the main body and the grinding piece.

7. The chemical mechanical polishing system of claim 1, wherein the accommodation space is surrounded by a plurality of the grinding pieces.

8. The chemical mechanical polishing system of claim 1, wherein the grinding piece has a ring shape, and the accommodation space is surrounded by the grinding piece.

9. The chemical mechanical polishing system of claim 1, further comprising a second polishing head.

10. A chemical mechanical polishing system comprising:
a platen;
a polishing pad disposed on the platen;
a slurry introducing device configured to supply slurry onto the polishing pad; and
at least one polishing head comprising:
a main body having an accommodation space for accommodating a wafer;
a retainer ring configured to retain the wafer, and
a plurality of grinding surfaces disposed on the retainer ring and configured to grind against the polishing pad, wherein the plurality of grinding surfaces are separated by a plurality of portions of the retainer ring that are void of a grinding surface, wherein at least one of the portions of the retainer ring that is void of the grinding surface abuts at least one of the grinding surfaces and has a side and the side substantially follows a line that passes through a center point of the retainer ring.

11. The chemical mechanical polishing system of claim 10, wherein the polishing head further comprises a plurality of grinding particles disposed on the grinding surfaces, the grinding particles are made of a material harder than the polishing pad.

12. The chemical mechanical polishing system of claim 11, wherein the grinding particles are made of diamond.

13. The chemical mechanical polishing system of claim 11, wherein the grinding particles are separated into a plurality of groups.

14. The chemical mechanical polishing system of claim 13, wherein the accommodation space is surrounded by the groups of grinding particles.

15. The chemical mechanical polishing system of claim 10, further comprising a second polishing head.

16. A chemical mechanical polishing system comprising:
a platen;
a polishing pad disposed on the platen;
a slurry introducing device over the polishing pad; and
at least one polishing head comprising a retainer ring configured to retain a wafer and at least one grinding piece disposed on the retainer ring, the grinding piece having a plurality of grinding surfaces configured to grind against the polishing pad and separated by a plurality of portions of the retainer ring that are void of a grinding surface, wherein at least one of the portions of the retainer ring that is void of the grinding surface abuts at least one of the grinding surfaces and has a side and the side substantially follows a line that passes through a center point of the retainer ring.

17. The chemical mechanical polishing system of claim 16, wherein the grinding piece is harder than the polishing pad.

18. The chemical mechanical polishing system of claim 16, wherein a quantity of the grinding piece is plural, and wherein the grinding pieces are circumferentially arranged.

19. The chemical mechanical polishing system of claim 16, wherein the grinding piece comprises a plurality of diamond particles in contact with the polishing pad.

20. The chemical mechanical polishing system of claim 16, further comprising a second polishing head.

* * * * *